US005382764A

United States Patent [19]

Demissy

[11] Patent Number: 5,382,764

[45] Date of Patent: Jan. 17, 1995

[54] VERTICALLY-OPENING SECTION SWTICH HAVING A ROCKING COLUMN

[75] Inventor: Daniel Demissy, Montreal, Canada

[73] Assignee: GEC Alsthom Energie, Inc., Quebec, Canada

[21] Appl. No.: 57,852

[22] Filed: May 7, 1993

[30] Foreign Application Priority Data

May 11, 1992 [FR] France ..... 92 05691

[51] Int. Cl.[6] ..... H01H 33/02; H01H 31/02

[52] U.S. Cl. ..... 200/146 R; 200/48 R; 200/144 R

[58] Field of Search ..... 200/146 R, 48 R–48 CB, 200/144 R, 148 R, 148 F, 237–261

[56] References Cited

U.S. PATENT DOCUMENTS

| | | | |
|---|---|---|---|
| 1,949,018 | 2/1934 | Koppitz | 200/48 R |
| 3,598,940 | 8/1971 | Smedley et al. | 200/485 B |
| 3,602,667 | 8/1971 | Reichi et al. | 200/144 R |
| 3,746,819 | 7/1973 | Linde | 200/146 R X |
| 4,001,530 | 1/1977 | Redfern | 200/48 A |
| 5,243,159 | 9/1993 | Demissy | 200/146 R |
| 5,276,286 | 1/1994 | Demissy et al. | 200/146 R |

FOREIGN PATENT DOCUMENTS

| | | |
|---|---|---|
| 1486192 | 5/1967 | France . |
| 306198 | 2/1929 | United Kingdom . |

*Primary Examiner*—J. R. Scott

*Attorney, Agent, or Firm*—Sughrue, Mion, Zinn, Macpeak & Seas

[57] ABSTRACT

A high voltage section switch of the type includes a female current terminal situated at one end of a first vertical insulating column, a control blade which is hinged at one end of a second vertical insulating column and which carries at its first end a male contact intended to co-operate with the female contact, movement of the blade being provided by a mechanism connected to a rocking insulating column. The hinge between the blade and the second column is provided by means of two levers of different lengths.

1 Claim, 2 Drawing Sheets

VERTICALLY-OPENING SECTION SWTICH HAVING A ROCKING COLUMN

FIELD OF THE INVENTION

The present invention relates to a section switch particularly for high voltages, the switch being of the type comprising a female current terminal at one end of a first vertical insulating column and a blade hinged at one end of a second vertical insulating column, a first end of the blade carrying a male contact intended to cooperate with said female contact, movement of said blade being provided by a mechanism connected to a rocking insulating column.

BACKGROUND OF THE INVENTION

A section switch of this type is described in British patent number 306198. In the section switch described in that document, the mechanism comprises a first lever hinged both to said blade and to said rocking column, a second lever hinged both to said blade and to said second vertical insulating column, and a cam which is integral with said second vertical insulating column and which co-operates with a roller arranged at the second end of said blade.

OBJECTS AND SUMMARY OF THE INVENTION

A first aim of the invention is to provide a section switch of the type previously described but of simpler construction.

The operation of the section switch described in the above-mentioned patent deteriorates considerably if ice forms on the cam or on the roller; the force exerted by the roller on the cam may be insufficient to break the ice so that movement of the blade is affected to the extent that it cannot close the section switch.

The invention further provides a section switch, the operation of which is unaffected by the presence of any ice which may form either on the blade movement mechanism or on the contacts.

The invention also provides a section switch utilizing thimble-type contacts which withstand short circuits better than jaw-type contacts.

All these aims are met by the invention which provides a high voltage section switch of the type comprising a female current terminal situated at one end of a first vertical insulating column, a control blade which is hinged at one end of a second vertical insulating column and which carries at its first end a male contact intended to co-operate with said female contact, movement of said blade being provided by a mechanism connected to a rocking insulating column, wherein the hinge of the switch between said blade and said second column is provided by means of two levers of different lengths, each lever having a first end connected to a part integral with said second insulating column and a second end connected to a respective separate point on said blade, said mechanism which connects the rocking column and said blade being formed by an arm hinged at one end to said rocking column and at its other end to said blade, said female contact being constituted by a substantially horizontal tube which is longitudinally split over part of its length to form contact fingers, said female contact being protected by a hood provided with ice-breaking barbs, said male contact having an enlarged portion which can engage between said fingers, the length and relative arrangement of said levers being chosen to ensure that when the section switch is opened, the initial blade movement has a horizontal component tending to separate the male and female contacts as well as a component tending to bring the end of the blade down to a level below that which it occupies when the section switch is closed, said movement being followed by rotation of the blade about the end of the second insulating column.

BRIEF DESCRIPTION OF THE DRAWINGS

The invention will be better understood from the description of an embodiment given with reference to the accompanying drawings in which.

DETAILED DESCRIPTION

In the description which follows, only one pole will be described, it being understood that a section switch for a three-phase line will comprise three identical poles.

Figure 1:
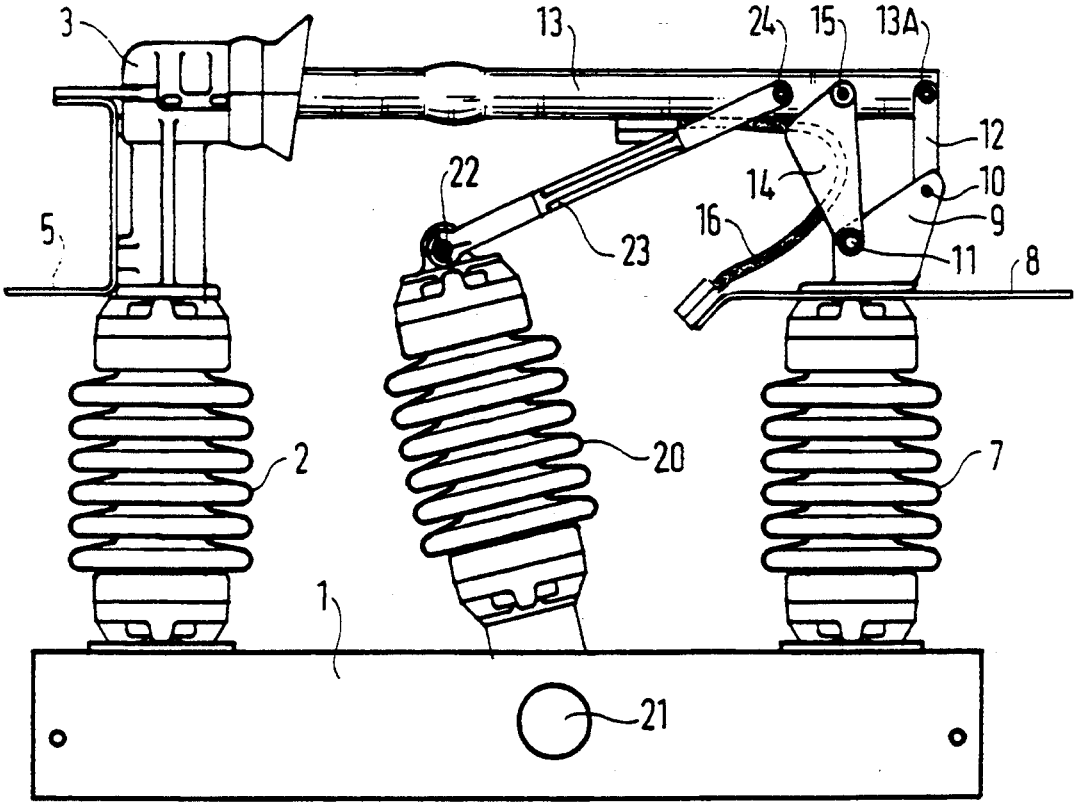
FIG. 1 is a side view of one pole of a section switch according to the invention, shown in the closed position.

Reference 1 in FIG. 1 designates a metal beam constituting the upper part of the frame of the section switch. This frame is not described in further detail as it is constructed in conventional manner and does not form part of the invention.

Figure 2:
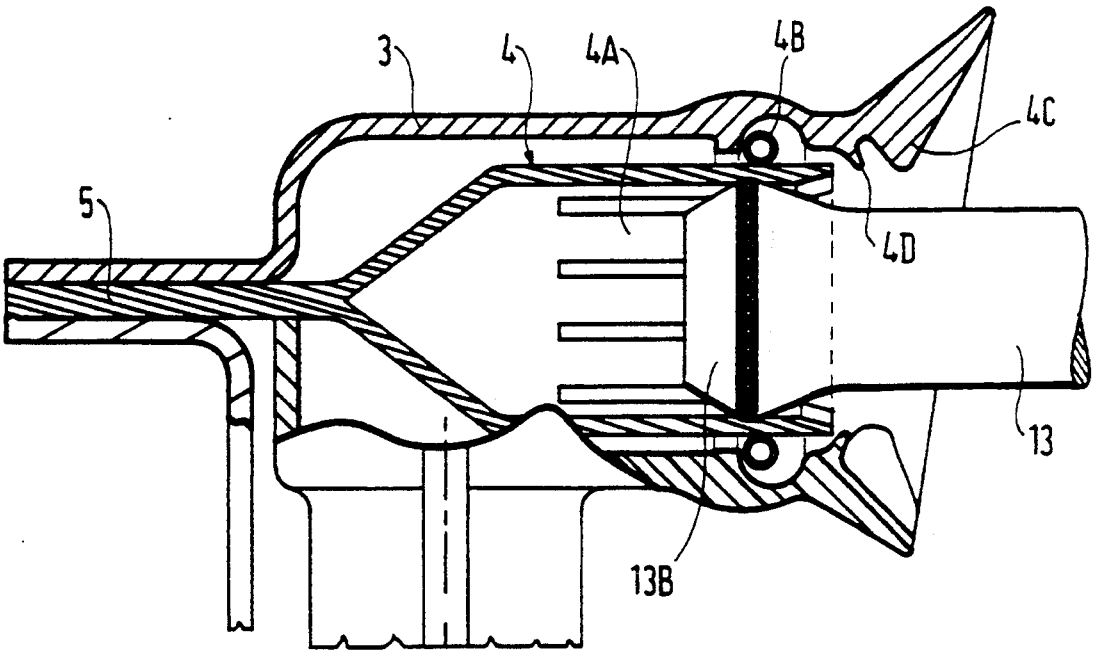
FIG. 2 is an axial section through the female contact of the pole of the section switch.

Secured to frame 1 is a first vertical insulating column 2 which carries a protective cap 3 containing a female electrical contact 4, visible in detail in FIG. 2 and comprising a tube which is longitudinally split over part of its length to form contact fingers 4A arranged in a manner known as a thimble. This female contact is intended to co-operate with a male contact to be described later. A spring 4B ensures contact pressure. The cap 3 is open in the shape of a horn and includes ice-breaking barbs 4C and a drainer 4D. Contact 4 is connected to a first current terminal 5.

Beam 1 also carries a second vertical insulating column 7 having a second current terminal 8. A vertical plate 9 with two hinge points 10 and 11 is secured to the top of column 7. Connected to the hinge point 10 is the first end of a first lever 12, the second end of which is hinged to one end 13A of a metal blade 13 whose other end carries a male contact 13B co-operating with the female contact 4. Connected to the hinge point 11 is the first end of a second lever 14, the other end of which is hinged to the blade 13 at a hinge point 15. When the section switch is in the closed position, the male contact is engaged in the female contact and electrical connection between the two terminals 5 and 8 is provided by the blade 13. The male contact 13B is constituted by a tube having an enlarged portion which ensures good contact pressure with the thimble contact. A metal braid 16 provides electrical connection between the terminal 8 and the blade 13.

It can be seen that a first feature of the invention is the use of thimble contacts instead of the usual jaw type contacts; this has two advantages:

firstly, the thimble contact withstands short circuits better; and secondly, ice has more difficulty in forming on the female contact since it is protected by the cap and since its opening is not upwardly directed.

Movement of the blade is provided by a rocking insulating column in the form of an insulating part 20 of the same type as columns 2 and 7 and hinged at its lower end about a fixed horizontal axis 21. This column is provided with means (not shown) allowing it to perform rocking movements in a vertical plane, the amplitude of said movements not exceeding about 20 degrees from the vertical. These means may comprise for example a rod secured to the bottom of the column 20 and associated with a driving mechanism which pulls on the rod.

The top of column 20 carries a hinge 22 to which is hinged the first end of an arm 23, the other end 24 of which is hinged to the blade 13.

Figure 3:
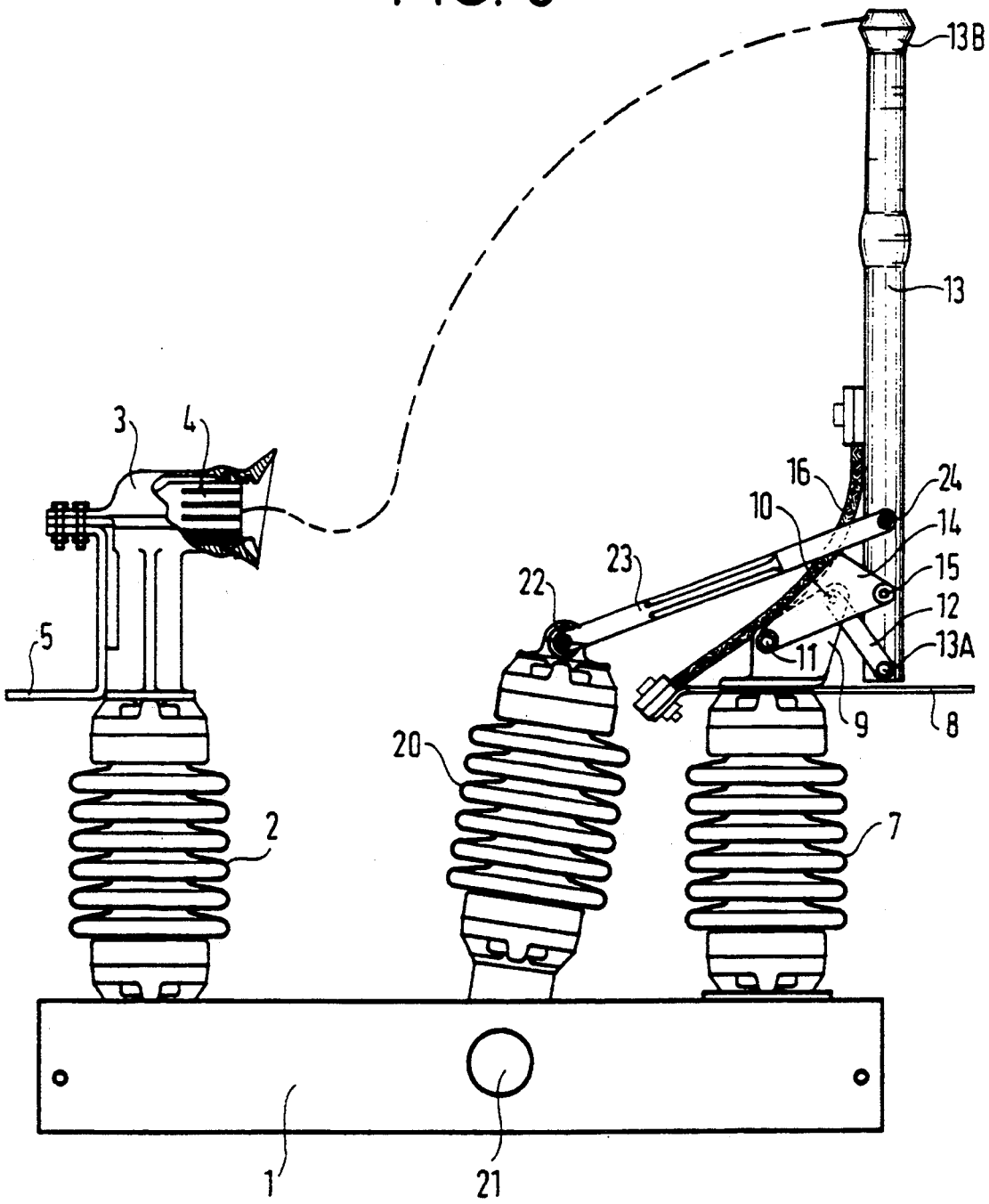
FIG. 3 is a side view of the same pole shown in the open position.

The operation of the section switch is as follows:

in the closed position, column 20 is inclined to its maximum extent and towards the left in FIG. 1;

to open the section switch, the control mechanism is moved so as to cause the column 20 to rock towards the right of the figure. Referring to FIG. 3, line 40 represents the displacement of the male contact during an opening operation of the section switch. Due to the nature of the connecting mechanism between the rocking column 20 and the blade 13, and in particular because the levers 12 and 14 are unequal in length, the end 13A of blade 13 at first moves in a straight line along its axis in the direction tending to separate the contacts 4 and 13B, this movement being associated with a slight lowering of the blade. Subsequently, the blade pivots in a vertical plane so as to reach the position shown in FIG. 3 which corresponds to the open position of the section switch, the blade then being vertical and ensuring a gap for electrical isolation between the contacts.

The section switch is closed by carrying out the same movements in reverse. Downward movement of the male contact to a position below the horizontal, followed by upward movement as the male contact nears the female contact, allow any ice which may have formed on the male contact to be broken on encountering the barbs 4C located at the entrance of the female contact.

The section switch of the invention is simple in construction and therefore less costly than prior art section switches.

The possibility of using a thimble-type contact allows short circuits to be withstood better than with jaw-type contacts.

Ice is less of a problem than in prior art section switches, because the contacts are engaged horizontally and a protective cap can be used.

It is to be understood that a schematic description of the device has been given. In particular, levers 12 and 14, an arm 23, and the associated components pertinent to the operation of the present invention have been described. Clearly these elements may be duplicated and arranged on either side of the blade, suitably spaced so as to permit them to cross, in order to form a symmetrical and balanced assembly.

The invention is suitable for section switches for high voltages, above 25 kV.

I claim:

1. A high voltage section switch of the type comprising a female current terminal comprising a female contact, said female current terminal being situated at one end of a first vertical insulating column, a control blade which is hinged at one end of a second vertical insulating column and which carries at its first end a male contact intended to co-operate with said female contact, movement of said blade being provided by a mechanism connected to a rocking insulating column, wherein the hinge between said blade and said second insulating column is provided by means of two levers of different lengths, each lever having a first end connected to a part integral with said second insulating column and a second end connected to a respective separate point on said blade, said levers and said blade being in a common vertical plane so as to communicate to said blade a movement in said vertical plane, said mechanism which connects the rocking column and said blade being formed by an arm hinged at one end to said rocking column and at its other end to said blade, said female contact being constituted by a substantially horizontal tube which is longitudinally split over part of its length to form contact fingers, said female contact being protected by a hood provided with ice-breaking barbs, said male contact having an enlarged portion which can engage between said fingers, the length and relative arrangement of said levers being chosen to ensure that when the section switch is opened, the initial blade movement has a horizontal component tending to separate the male and female contacts as well as a component tending to bring the end of the blade down to a level below that which it occupies when the section switch is closed, said movement being followed by rotation of the blade about the end of the second insulating column.

* * * * *